US006698363B2

(12) United States Patent
Mallon

(10) Patent No.: US 6,698,363 B2
(45) Date of Patent: Mar. 2, 2004

(54) EXTENDABLE TABLE

(75) Inventor: Nathaniel B. Mallon, Allston, MA (US)

(73) Assignee: Outdoor Designs, Ltd., Waterbury, CT (US)

( * ) Notice: Subject to any disclaimer, the term of this patent is extended or adjusted under 35 U.S.C. 154(b) by 0 days.

(21) Appl. No.: 10/208,295

(22) Filed: Jul. 30, 2002

(65) Prior Publication Data

US 2004/0020412 A1 Feb. 5, 2004

(51) Int. Cl.[7] ..... A47B 1/04
(52) U.S. Cl. ..... 108/83; 108/50.12
(58) Field of Search ..... 108/83, 86, 87, 108/88, 89, 50.12, 85, 66, 65

(56) References Cited

U.S. PATENT DOCUMENTS

| | | | | | |
|---|---|---|---|---|---|
| 1,173,665 | A | * | 2/1916 | Jakab | 108/50.12 |
| 1,584,621 | A | * | 5/1926 | Lovato | 108/83 |
| 1,890,409 | A | * | 12/1932 | Roberts | 108/35 |
| 2,772,132 | A | * | 11/1956 | Kaylor | 108/83 |
| 3,336,882 | A | * | 8/1967 | Edelson | 108/83 |
| 4,878,439 | A | * | 11/1989 | Samson | 108/83 |
| 5,335,803 | A | * | 8/1994 | O'Brien et al. | 211/163 |
| 6,065,466 | A | * | 5/2000 | Baykal | 126/41 R |

FOREIGN PATENT DOCUMENTS

| | | |
|---|---|---|
| EP | 0220615 | * 10/1986 |

* cited by examiner

*Primary Examiner*—Jose V. Chen
(74) *Attorney, Agent, or Firm*—Raymond A. Nuzzo

(57) ABSTRACT

An extendable table comprising a frame having legs, and first and second table top portions movably attached to the frame. The first table top portion has an end defining a cut-out. The second table top portion has an end that is opposite to the end of the first table top portion and which defines a cut-out that is generally aligned with to the cut-out defined by the end of the first table top portion. The first and second table top portions are movable toward each other so that the ends of the first and second table top portions abut each other and the cut-outs cooperate to form an opening for receiving an umbrella support post. The first and second table top portions are movable away from each other so as to form a space between the first and second table top portions which exposes a portion of the frame. A center table top portion is removably positioned on the portion of the frame exposed within the space between the first and second table top portions. The center table top portion has protruding members that are sized for insertion into the cut-outs of the first and second table top portions. The center table top portion includes a central opening for receiving a support post of an umbrella.

20 Claims, 3 Drawing Sheets

EXTENDABLE TABLE

BACKGROUND OF THE INVENTION

1. Field of the Invention

The present invention relates to an extendable table.

2. Description of Related Art

Extendable tables are known in the art. Examples of such extendable tables are described in U.S. Pat. Nos. 4,475,464, 4,815,393, 4,878,439, and 5,735,220. These aforementioned extendable tables do not provide any means for securing an umbrella when the table is in the extended configuration.

SUMMARY OF THE INVENTION

It is therefore an object of the present invention to provide an extendable table that can support an umbrella when the table is either extended or not extended.

It is another object of the present invention that the aforementioned extendable table of the present invention be easy to use and relatively inexpensive to manufacture.

Other objects and advantages of the present invention will be apparent from the ensuing description.

Thus, the present invention is directed to, in one aspect, an extendable table that comprises a frame having legs, and first and second table top portions movably attached to the frame. The first table top portion has an end defining a cut-out. The second table top portion has an end that is opposite to the end of the first table top portion and which defines a cut-out that is generally aligned with the cut-out defined by the end of the first table top portion. When the extendable table of the present invention is to be configured in the closed configuration, the first and second table top portions are moved toward each other so that the ends of the first and second table top portions abut each other and the cut-outs cooperate to form an opening for receiving an umbrella support post. When the extendable table of the present invention is to be configured in the expanded configuration, the first and second table top portions are moved away from each other so as to form a space between the first and second table top portions. A portion of the frame is exposed within the space. The extendable table of the present invention further comprises a center table top portion that is removably positioned on the portion of the frame exposed within the space between the first and second table top portions. The center table top portion includes a central opening for receiving a support post of an umbrella. The center table top portion has protruding members that are sized for insertion into the cut-outs of the first and second table top portions. Thus, the extendable table of the present invention can support an umbrella when in the closed configuration and expanded configuration.

BRIEF DESCRIPTION OF THE DRAWINGS

The foregoing features of the present invention will become more readily apparent and may be understood by referring to the following detailed description of an illustrative embodiment of the present invention, taken in conjunction with the accompanying drawings, in which.

DESCRIPTION OF THE PREFERRED EMBODIMENTS

Figure 1:
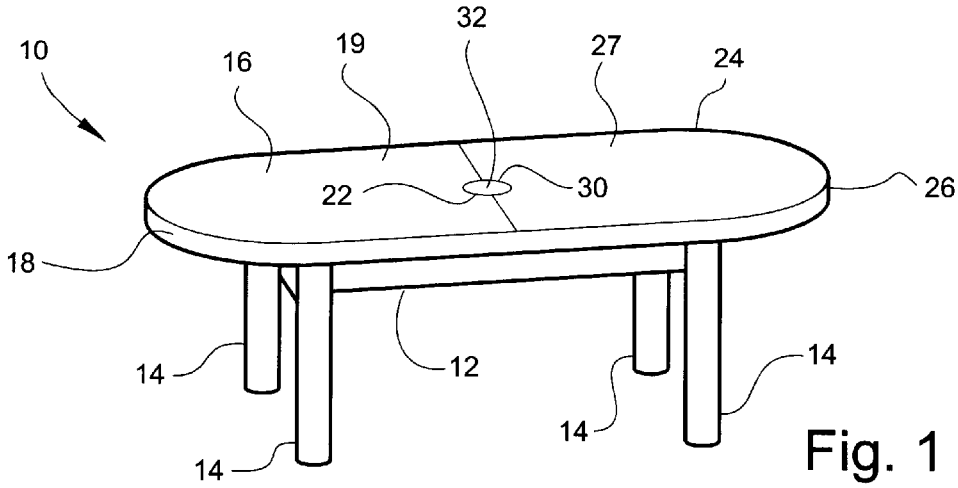
FIG. 1 is a perspective view of an extendable table in accordance with one embodiment of the present invention.
Figure 2:
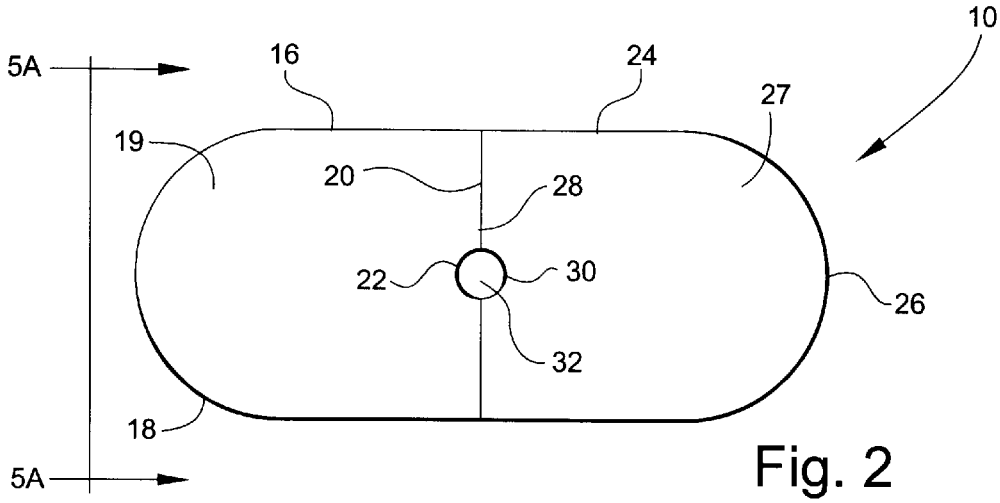
FIG. 2 is a top plan view of the extendable table of FIG. 1.
Figure 3:
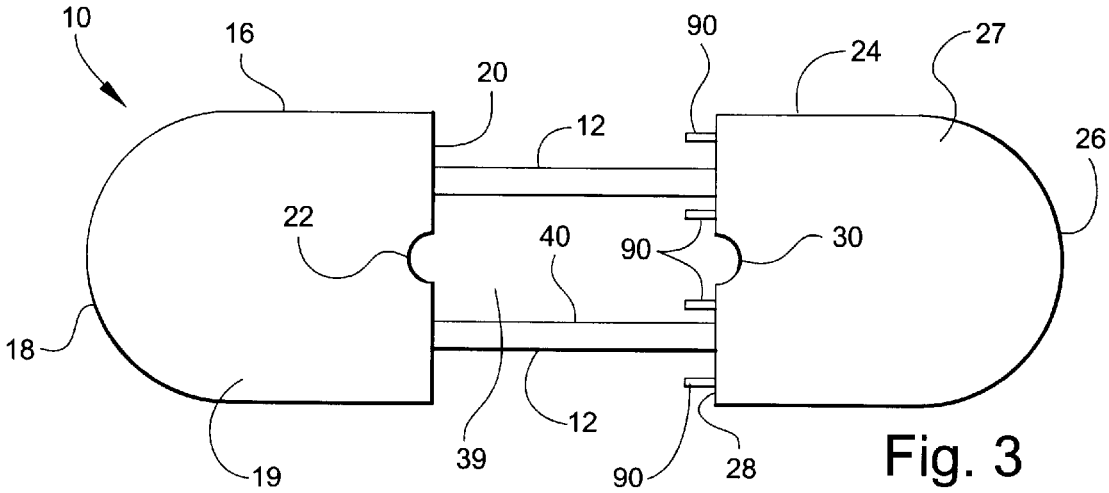
FIG. 3 is top plan view of the extendable table of FIG. 1 wherein the table top portions are moved away from each other.

Referring to FIGS. 1 and 3, there is shown one embodiment of the extendable table of the present invention. Extendable table 10 has frame 12 and legs 14 attached to frame 12. Table 10 further comprises table top portion 16 movably attached to the frame 12. Table top portion 16 has perimetrical edge portion 18 and top surface 19 within perimetrical edge portion 18. Perimetrical edge portion 18 includes portion 20 which defines cut-out 22. Table 10 further comprises table top portion 24 movably attached to the frame 12. Table top portion 24 has perimetrical edge portion 26 and top surface 27 within perimetrical edge portion 26. Perimetrical edge portion 26 includes portion 28 which defines cut-out 30. Cut-outs 22 and 30 are generally aligned with one another as shown in FIG. 3. Edge portions 20 and 28 of table portions 16 and 24, respectively, are opposite to and abut one another when table 10 is in the closed or non-extended configuration as shown in FIG. 2. When table 10 is in the closed or non-extended configuration, cut-outs 22 and 30 confront each other and cooperate to form opening 32. In a preferred embodiment, cut-outs 22 and 30 are generally semi-circular shaped so that opening 32 is generally circular shaped. A generally circular shaped opening 32 conforms to the generally cylindrical shaped umbrella pole commonly found in many patio and beach umbrellas. As shown in FIG. 3, when table top portions 16 and 24 are moved away from each other, space 39 is formed which exposes portion 40 of frame 12.

Figure 4:
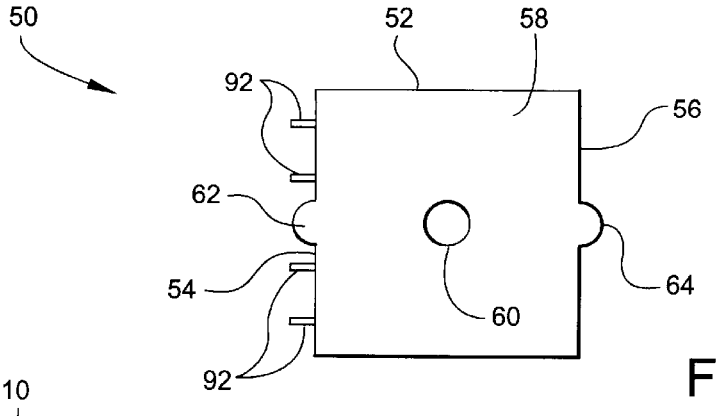
FIG. 4 is top plan view of a center table top portion used with the extendable table of FIG. 1.

Referring to FIG. 4, there is shown center table top portion 50 which is used with table 10. Center table top portion 50 includes perimetrical edge 52 which includes opposite portions 54 and 56 and a top surface 58 within perimetrical edge 52. Top surface 58 defines opening 60. In a preferred embodiment, opening 60 is centrally located and is generally circular in shape. Opening 60 is sized to receive the support post or pole of a beach or patio umbrella. Portion 54 of center table top portion 50 defines a protruding portion 62 that is sized to fit into cut-out 22. In a preferred embodiment, protruding portion 62 has shape that corresponds to the shape of cut-out 22. In a preferred embodiment, protruding portion 62 has a generally semi-circular shape. Portion 56 of center table top portion 50 defines a protruding portion 64 that is sized to fit into cut-out 30. In a preferred embodiment, protruding portion 64 has shape that corresponds to the shape of cut-out 30. In a preferred embodiment, protruding portion 64 has a generally semi-circular shape.

Figure 5:
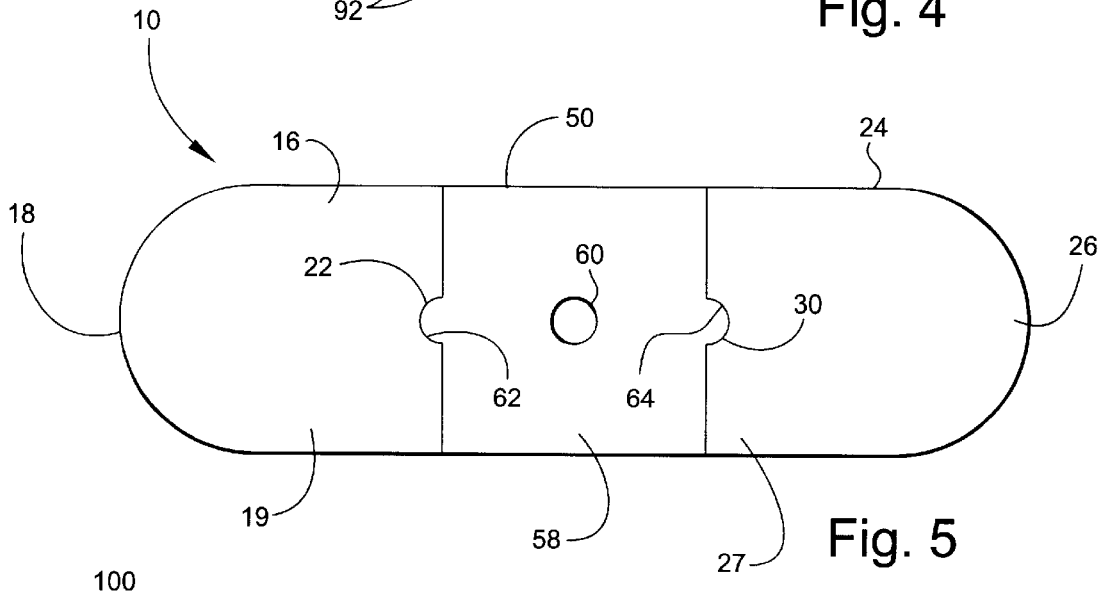
FIG. 5 is top plan view of the extendable table of the present invention in the extended configuration.

Referring to FIGS. 3 and 5, when it is desired to extend table 10, table top portions 16 and 24 are moved apart and center table top portion 50 is removably positioned within space 39 so that center table top portion 50 is supported by frame portion 40. When center table top portion 50 is positioned on frame portion 40, edge portion 54 of center table portion 50 abuts the edge portion 20 of table top portion 16, protruding portion 62 is inserted into cut-out 22, edge portion 56 of center table portion 50 abuts the edge portion 28 of table top portion 24, and protruding portion 64 is inserted into cut-out 30.

Thus, as shown in FIG. 5, when table 10 is in the extended configuration, protruding portions 62 and 64 are inserted into cut-outs 22 and 30, respectively, and an umbrella support post (not shown) can be inserted into opening 60. When table 10 is in the closed or non-extended configuration as shown in FIG. 2, center table top portion 50 is removed and an umbrella support post (not shown) can be inserted into opening 32 formed by cut-outs 22 and 30. Therefore, an umbrella can be used with table 10 whether table 10 is in the extended or non-extended configuration.

Figure 5A:
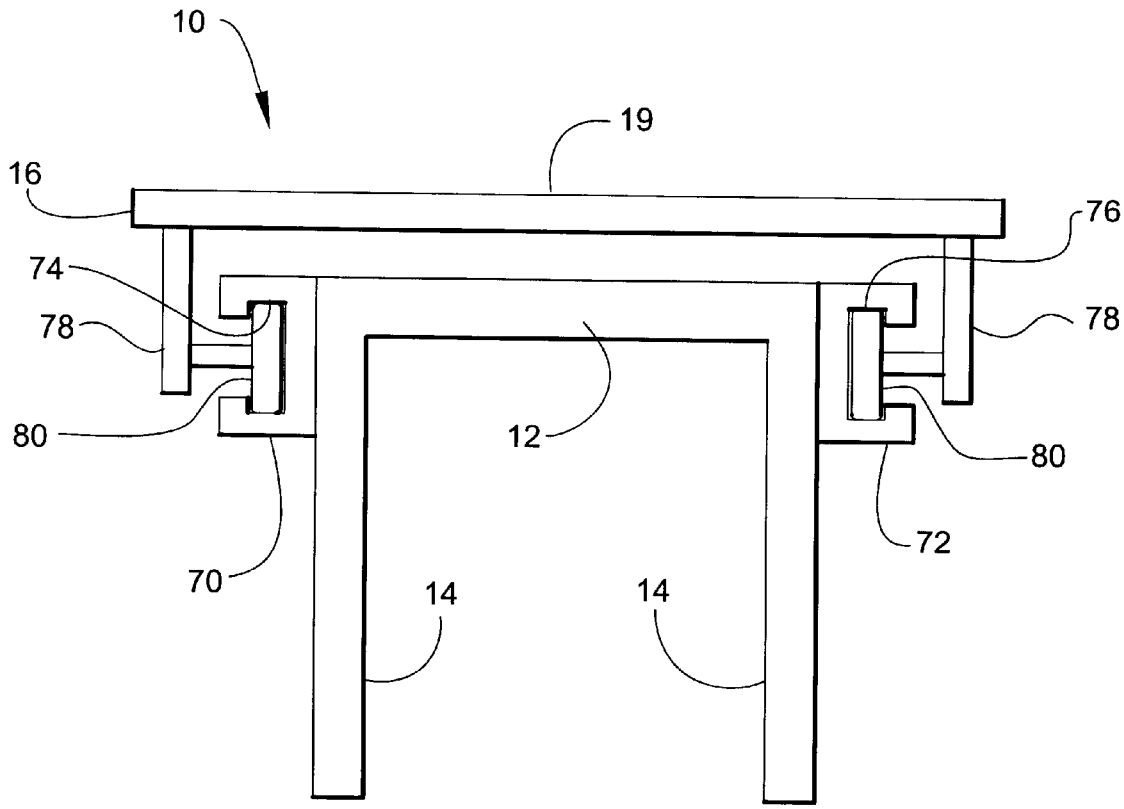
FIG. 5A is an end view taken along line 5A—5A in FIG. 2.

It is to be understood that any suitable techniques known in the art may be used to movably attach table top portions 16 and 24 to frame 12. In a preferred embodiment, table top portions 16 and 24 are slidably attached to frame 12. FIG. 5A illustrates one example of how table top portions 16 and 24 may be slidably attached to frame 12. In such an embodiment, frame 12 includes rails 70 and 72 which are generally parallel to one another and which extend along the length of the table. Rails 70 and 72 have tracks 74 and 76, respectively. Each table top portion 16 and 24 (only table top portion 16 is shown) includes support members 78 that are attached to the bottom sides of table top portions 16 and 24. Rollers 80 are rotatably attached to members 78 and are engaged within tracks 74 and 76. Such a configuration facilitates sliding movement of table top portions 16 and 24 with respect to frame 12. Legs 14 are rigidly attached to rails 70 and 72. It is to be understood that the configuration shown in FIG. 5A is just one example and that there are other suitable techniques and configurations for movably attaching table top portions 16 and 24 to frame 12.

Referring to FIGS. 3 and 4, table top portion 24 includes members or tabs 90 that extend from edge portion 28 and which are inserted into openings (not shown) in edge portion 20 of table top portion 16. Such a configuration provides stability and structural integrity when table 10 is in the closed configuration. Referring to FIG. 4, center table top portion 50 includes members or tabs 92 that extend from edge 54 and openings (not shown) that are in edge portion 56. When table 10 is in the open configuration, members or tabs 92 are inserted into the openings in edge 20 of table top portion 16 and members or tabs 90 of table top portion 24 are inserted into openings in edge portion 56 of table top portion 50. Such a configuration provides stability and structural integrity when table 10 is in the extended configuration.

Figure 6:
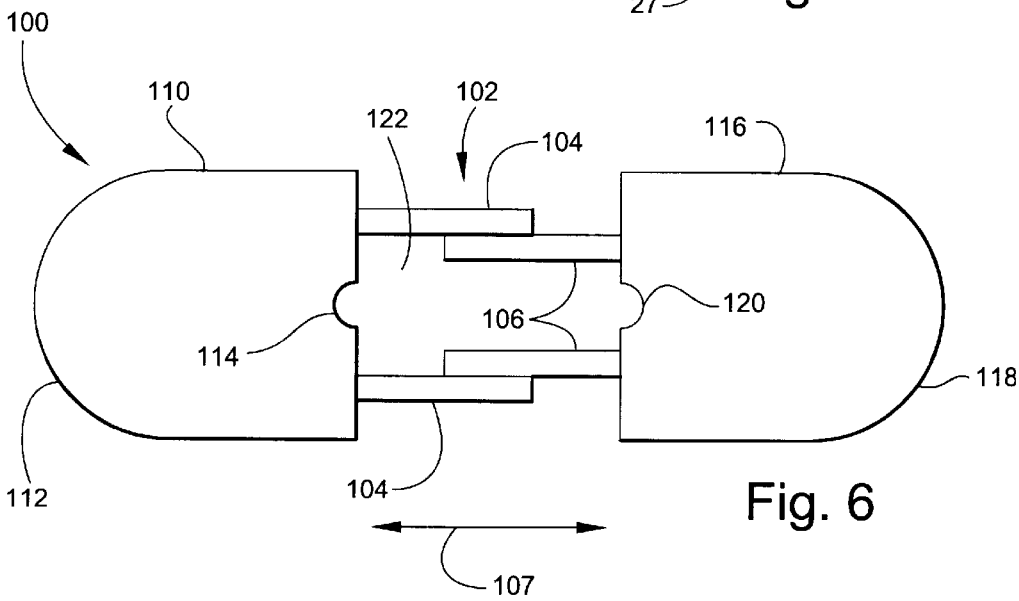
FIG. 6 top plan view, similar to FIG. 3, of an extendable table in accordance with another embodiment of the present invention.

Referring to FIG. 6, there is shown an alternate embodiment of the present invention. Extendable table 100 comprises extendable frame 102 having first frame section 104 and second frame section 106. Frame sections 104 and 106 are movably attached to one another and can move bi-directional as indicated by arrow 107. Extendable table 100 includes legs (not shown) that are attached to frame sections 104 and 106. Extendable table 100 further comprises table top portion 110 which is rigidly attached to frame section 104. Table top portion 110 has a perimetrical edge portion 112 which defines cut-out 114. Extendable table 100 further comprises table top portion 116 which is rigidly attached to frame section 106. Table top portion 116 has a perimetrical edge portion 118 which defines cut-out 120. Cut-outs 114 and 120 function in the same manner as cut-outs 22 and 30, respectively, which were described in the foregoing description. In order to configure table 100 in the closed or non-extended configuration, frame sections 110 and 116 are moved toward each other so that table top portions 110 and 116 abut each other and cut-outs 114 and 120 cooperate to form an opening (not shown) in a similar manner in which opening 32 of extendable table 10 is formed by cut-outs 22 and 30. In order to configure extendable table 100 in the extended configuration, frame sections 110 and 116 are moved away from each other to form space 122 between table top portions 110 and 116 and a center table top portion (not shown) similar to center table top portion 50 is then inserted into space 122. The main difference between extendable table 10 and extendable table 100 is that in extendable table 10, table top portions 16 and 24 are movable attached to frame 12 whereas in extendable table 100, table top portions 110 and 116 are rigidly attached to movable frame sections 104 and 106, respectively.

It is to be understood that the components and parts of tables 10 and 100 can be configured to have any one of a variety geometrical shapes, e.g. circular, rectangular, square, oval, etc. Furthermore, tables 10 and 100 can be fabricated from any one of a variety of materials, e.g. metal, plastic, etc.

The principals, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations in changes may be made by those skilled in the art without departing from the spirit of the invention. Accordingly, the foregoing detailed description should be considered exemplary in nature and not limited to the scope and spirit of the invention as set forth in the attached claims.

What is claimed is:

1. An extendable table comprising:

a frame having legs;

a first table top portion slidably attached to the frame, the first table top portion having an end defining a cut-out; and a second table top portion slidably attached to the frame, the second table top portion having an end that is opposite to the end of the first table top portion and which defines a cut-out that is generally aligned with and complementary to the cut-out defined by the end of the first table top portion; and said first and second table top portions being slidable toward each other so that the ends of the first and second table top portions abut each other and the cut-outs form an opening, said first and second table top portions being slidable away from each other so as to form a space between the first and second table top portions which exposes a portion of the frame.

2. The extendable table according to claim 1 further comprising a center table top portion that is sized to be removably positioned on the portion of the frame exposed within the space formed when the first and second table top portions are moved away from each other.

3. The extendable table according to claim 2 wherein the center table top portion includes opposite ends and a top surface between the opposite ends, the top surface defining an opening, each of the opposite ends of the center table top portion defining a protruding member that is sized to fit into a corresponding one of the cut-outs whereby when the center table top portion is positioned on the portion of the frame exposed within the space, one of the opposite ends of the center top portion abuts the end of the first table top portion and the other of the opposite ends of the center table top portion abuts the end of the second table top portion, and each protruding member is inserted into a corresponding one of the cut-outs.

4. The extendable table according to claim 3 wherein each protruding member is generally semi-circular shaped.

5. The extendable table according to claim 4 wherein each cut-out is generally semi-circular shaped.

6. The extendable table according to claim 3 wherein the opening in the center table portion is generally centrally located.

7. The extendable table according to claim 3 wherein the opening in the center table portion is generally circular in shape.

8. The extendable table according to claim 3 wherein the protruding members are generally aligned with each other.

9. The extendable table according to claim 1 wherein each cut-out is generally semi-circular shaped.

10. An extendable table comprising:

an extendable frame having a first frame section and second frame section, the first and second frame sections being movably attached to one another;

a plurality of legs attached to each frame section;

a first table top portion attached to the first frame section, the first table top portion having an end defining a cut-out; and a second table top portion attached to the second frame section, the second table top portion having an end that is opposite to the end of the first table top portion and which defines a cut-out that is generally aligned with and complementary to the cut-out defined by the end of the first table top portion;

said first and second frame sections being slidable toward each other so that the ends of the first and second table top portions abut each other and the cut-outs cooperate to form an opening, said first and second frame sections being slidable away from each other so as to form a space between the first and second table top portions which exposes portions of the first and second frame sections.

11. The extendable table according to claim 10 further comprising a center table top portion that is sized to be removably positioned on the portion of the frame exposed within the space formed when the first and second frame sections are slid away from each other.

12. The extendable table according to claim 11 wherein the center table top portion has opposite ends and a top surface between the opposite ends, the top surface of the center table top portion defining an opening, each of the opposite ends of the center table top portion defining a protruding member that is sized to fit into a corresponding one of the cut-outs whereby when the center table top portion is positioned on the portion of the portions of the first and second frame sections exposed within the space, one of the opposite ends of the center top portion abuts the end of the first table top portion and the other of the opposite ends of the center table top portion abuts the end of the second table top portion, and each protruding member is inserted into a corresponding one of the cut-outs.

13. The extendable table according to claim 12 wherein the protruding members are generally aligned with each other.

14. The extendable table according to claim 11 wherein the opening formed by the cut-outs is generally circular in shape.

15. The extendable table according to claim 11 wherein the opening in the top surface of the center table top portion is centrally located with respect to the opposite ends.

16. The extendable table according to claim 11 wherein the opening in the top surface of the center table top portion is generally circular in shape.

17. A center table top portion for use with an extendable table having a frame and a pair of table top portions that are movably attached to the frame wherein the table top portions are movable toward or away from each other and wherein the center table top portion is sized to be removably positioned between the pair of table top portions, the center table top portion comprising opposite ends, and a top surface between the opposite ends, the center table top portion further comprising a pair of protruding portions, each protruding portion extending from a corresponding one of the opposite ends and having a top surface that is substantially coplanar with the top surface of the center table top portion.

18. The center table top portion according to claim 17 wherein each protruding portion is generally semi-circular shaped.

19. The center table top portion according to claim 17 wherein the protruding portions are generally aligned with each other.

20. The center table top portion according to claim is 17 wherein the shape of the center table top portion is generally rectangular.

* * * * *